US005255988A

United States Patent [19]

Yamamoto

[11] Patent Number: 5,255,988

[45] Date of Patent: Oct. 26, 1993

[54] PRINTING HEAD FOR USE IN WIRE IMPACT DOT PRINTERS HAVING HEAD COOLING MEANS

[75] Inventor: Kazuhiko Yamamoto, Suwa, Japan

[73] Assignee: Seiko Epson Corporation, Tokyo, Japan

[21] Appl. No.: 667,892

[22] Filed: Mar. 12, 1991

[30] Foreign Application Priority Data

Mar. 13, 1990 [JP] Japan ..... 2-61667
Aug. 31, 1990 [JP] Japan ..... 2-230323

[51] Int. Cl.[5] ..... B41J 2/235
[52] U.S. Cl. ..... 400/124; 101/93.05
[58] Field of Search ..... 400/124, 124 TC; 101/93.05

[56] References Cited

U.S. PATENT DOCUMENTS

| | | | |
|---|---|---|---|
| 3,836,823 | 9/1974 | Shields | 174/16.1 |
| 4,411,538 | 10/1983 | Asan et al. | 101/93.05 |
| 4,764,804 | 8/1988 | Sahara et al. | 174/16.3 |
| 4,795,283 | 10/1987 | Moriya et al. | 400/124 |
| 4,832,515 | 5/1989 | Kawakami | 101/93.05 |

FOREIGN PATENT DOCUMENTS

| | | | |
|---|---|---|---|
| 0106657 | 4/1984 | European Pat. Off. | 400/124 TC |
| 0005276 | 1/1983 | Japan | 400/124 TC |
| 0049988 | 3/1984 | Japan | 400/124 TC |
| 0071880 | 4/1984 | Japan | 400/124 TC |
| 0098866 | 6/1984 | Japan | 400/124 TC |
| 0136282 | 8/1984 | Japan | 400/124 TC |
| 0249755 | 10/1987 | Japan | 400/124 TC |

*Primary Examiner*—Edgar S. Burr
*Assistant Examiner*—John S. Hilten
*Attorney, Agent, or Firm*—Blum Kaplan

[57] ABSTRACT

A printing head for use in a wire impact dot printer comprising a cylindrical heat radiating member, core block and nose frame. The core block is inserted into the heat radiating member and hermetically joined thereto by a heat conductive resin material. The heat radiating member has a mounting portion which is utilized to join the heat radiating member to a mounting reference surface of the carriage. The nose frame is secured to the heat radiating member by a positioning and fixing portion which registers with the mounting portion of the heat radiating member and mounting reference surface of the carriage.

54 Claims, 2 Drawing Sheets

PRINTING HEAD FOR USE IN WIRE IMPACT DOT PRINTERS HAVING HEAD COOLING MEANS

BACKGROUND OF THE INVENTION

The present invention relates to a printing head for use in wire impact dot printers, and more particularly to a printing head suitable for wire impact dot printers characterized by heat radiating means and nose frame positioning and fixing means.

Conventionally, a printing head for use in wire impact dot printers includes a heat radiating member with a fin, inserted around a core block which dissipates heat generated by a coil into the air.

This structure, however, has disadvantages when high density characters are printed continuously at high speed. The heat generated by the coil exceeds the amount of heat dissipated by the heat radiating member so that continuous printing is precluded. In order to overcome this problem, Japanese Laid-Open Utility Model Publication No. 63-68436, which corresponds to U.S. Pat. No. 4,795,283, proposes a printing head which releases the heat generated by the coil through the printer carriage or guide shaft.

A nose base as a heat radiating member is mounted directly to the carriage to conduct heat to the carriage. In addition, both the nose frame and the core block are positioned so that both contact the reference surface of the nose base, thus increasing the mountability and the heat radiating effect due to heat conduction. This structure has a disadvantage in that an unavoidable gap is formed between the carriage and core block. This gap does not provide sufficient heat conduction, and in addition, it cannot absorb an impact force which is exerted against the nose frame during printing. The impact force can detrimentally affect the nose frame and other components of the printer.

SUMMARY OF THE INVENTION

The present invention is provided to overcome such problems. An object of the present invention is to provide an improved printing head for use in a wire impact type dot printer wherein heat from a core block as well as the impact force applied to the nose frame during printing can be effectively released to a carriage.

In order to overcome the problems, a printing head for use in a wire impact dot printer of the invention includes a heat radiating member into which a core block is mounted by a heat conductive resin material; a mounting portion formed on a portion of the heat radiating member and positioned firmly in contact with the reference surface of the carriage; and a positioning and fixing portion formed on a portion of the nose frame, so that the nose frame can be positioned relative to the mounting portion of the heat radiating member and the positioning portion of the carriage. The core block can be hermetically sealed in the heat radiating member with the conductive resin material.

The heat radiating member is firmly secured to the mounting reference surface of the carriage while the nose frame is mounted to the heat radiating member, using the mounting portion of the heat radiating member and the positioning portion on the carriage as references. Each of these parts is positioned firmly and accurately. Any impact force acting against the nose frame during printing is released to the carriage.

Furthermore, some or all of the heat can be effectively released to the print carriage and guide shaft via the mounting portion which is secured on the mounting reference surface of the carriage. In addition, heat produced by the coil can also be dissipated to the heat radiating member via the heat conductive resin.

An object of the invention is to provide a printing head which effectively dissipates heat through the heat radiating member and the printer carriage.

Another object of the invention is to provide a printing head which effectively releases the force applied to the printing head during printing.

Still other objects and advantages of the invention will in par be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

First Embodiment

Figure 1:
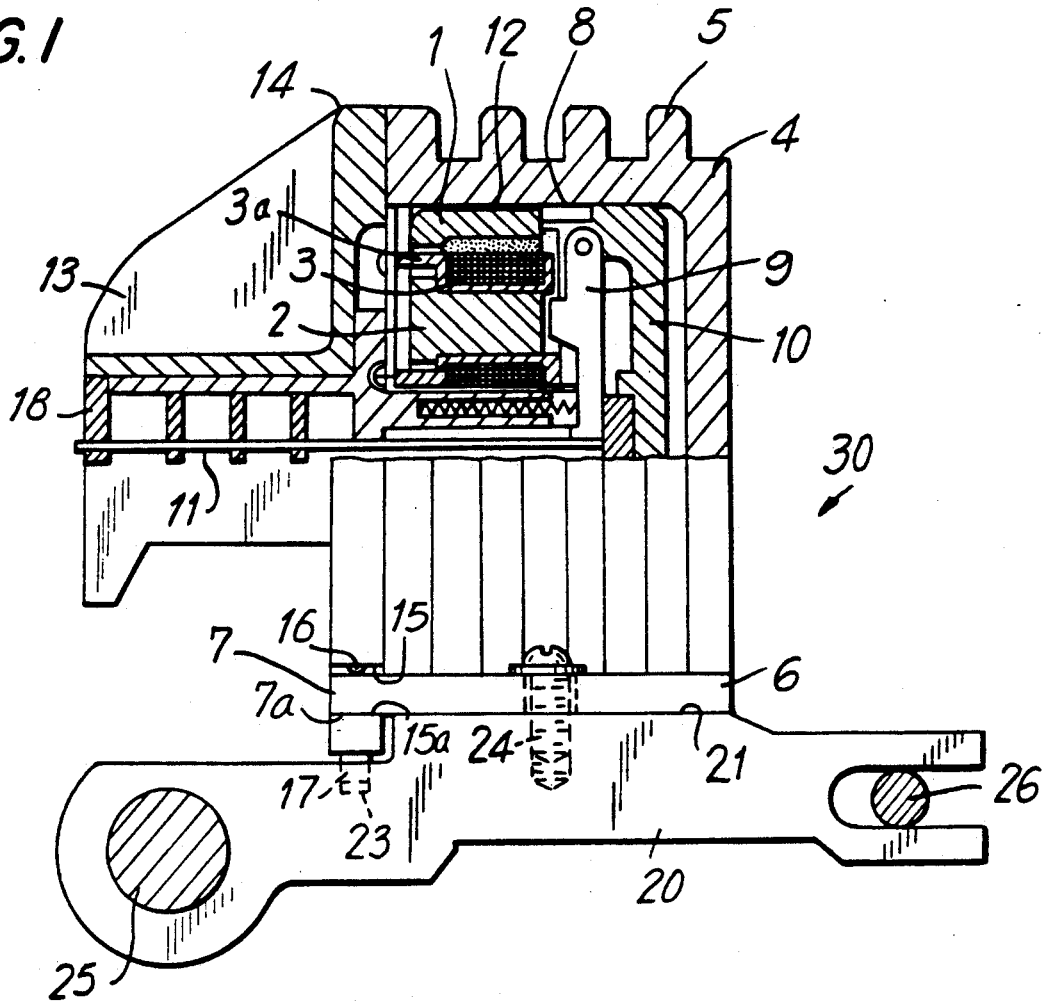
FIG. 1 is a side elevational view, partly in cross section, showing an embodiment of the printing head device in accordance with the present invention.
Figure 2:
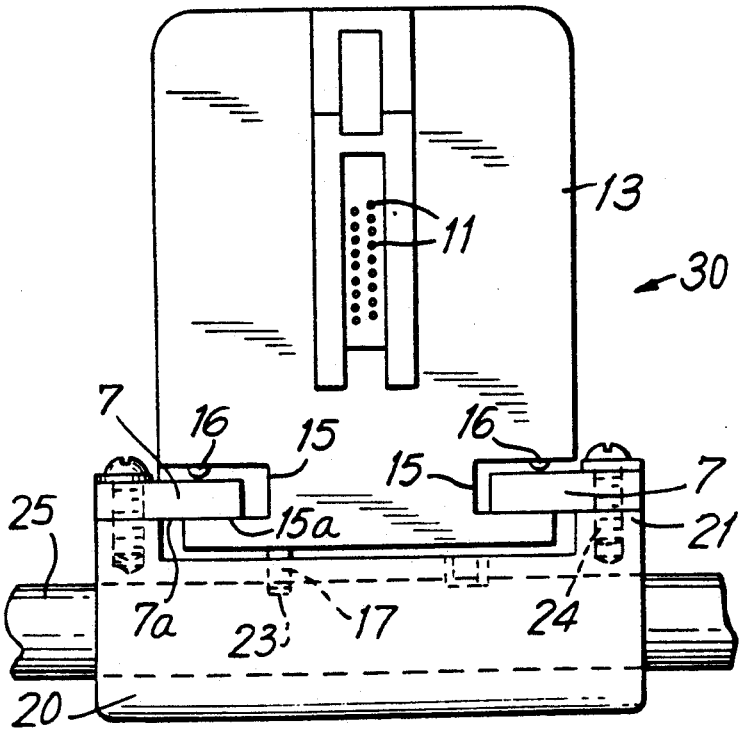
FIG. 2 is a front elevational view showing an embodiment of the printing head device in accordance with the present invention.

Referring specifically to FIGS. 1 and 2, a print head in accordance with a first embodiment of the invention is illustrated. A core block 1 acting as a heat source is formed essentially in a cup shape. The cross-sectional region of FIG. exposes the mechanism for actuating one of the eighteen print wires 11 in the print head, there being seventeen other such mechanisms distributed around the inside periphery of core block 1. A plurality of cores 2 (each associated with one print wire 11), each of which supports a coil bobbin 3*a* with coil 3 wound thereon, are arranged on the inside lower surface of core block 1 and are circular in lateral cross-section. A heat radiating member 4, acting as a heat sink, has a plurality of heat radiating fins 5 on the outer side surface thereof and is formed in essentially a cup shape with the open end of core block 1 facing the closed end of heat radiating member 4. Core block 1 is inserted inside heat radiating member 4 together with one or more yokes 8, a plurality of printing levers 9, and a press plate 10. The assembly is held together and hermetically sealed by a heat conductive resin material 12 (e.g. silicon resin) coated around the outer periphery of core block 1. Each printing lever 9 is pivotably supported on press plate 10 at one end thereof and supports one end of a print wire 11 at the other end thereof. A mounting portion 6 is formed on the lower end surface of heat radiating member 4 s as to extend laterally in a side direction and to define a flange. Mounting portion 6 is engaged firmly on a mounting reference portion 21 of a carriage 20 and held there by screws 24.

Mounting portion 6 and carriage 20 are cut during the manufacturing process with great precision so that mounting reference surface 21 couples with mounting portion 6 without any gaps. The cutting process can improve the heat conduction 10 to 20 times in comparison with a surface of an un-machined diecast member.

A pair of nose frame mounting portions 7 are integrally formed on mounting portion 6 so as to extend laterally toward the open end of heat radiating member 4 to define a further flange. A nose frame 13 is mounted on the lower surface 7*a* of nose frame mounting portions 7. Nose frame 13 includes a pair of laterally extending recessed portions 15 which receive nose frame mounting portions 7 of heat radiating member 4. Nose frame 13 is formed on the peripheral ends of a back plate 14, which is mounted to the open end of heat radiating member 4. Nose frame 13 is provided with a wire guide 18 fixed on the end portion thereof. Wire guide 18 is provided with a plurality of holes arranged in two rows to guide the end portions of printing wires 11. A protrusion 16 protrudes downward from the upper surface (as viewed in FIG. 2) of each recessed portion 15 to engage the upper surface of the corresponding nose frame mounting portion 7. This arrangement forces the lower surface 7*a* of each nose frame mounting portion 7 into firm contact with the upper surface of the corresponding recessed portion 15. This allows nose frame 13 to be mounted firmly and accurately to heat radiating member 4 with lower surfaces 7*a* of nose frame mounting portions 7 acting as a reference. Upper surfaces 15*a* of recessed portions 15 and lower surfaces 7*a* of nose frame mounting portions 7 must also be precisely machined to provide a solid fit. Additional screws 24 hold frame mounting portions 7 to carriage 20 and in engagement with mounting reference surface 21.

A positioning joggle 17 is formed so as to protrude downwardly (as viewed in FIG. 2) from the lower surface of back plate 14. Nose frame 13 is positioned horizontally by engaging joggle 17 into a positioning opening 23 formed on the upper surface of carriage 20.

Printing is effected by the energization of the coil on one or more of coil 3 to create a magnetic attraction between the corresponding core 2 and printing lever 9 to displace a print wire 11. Carriage 20 is mounted on first guide shaft 25 and second guide shaft 26 to permit moving carriage 20 therealong.

Core block 1, which is assembled integrally with yokes 8, printing levers 9 and press plate 10, is inserted inside heat radiating member 4 via a heat conductive resin material 12 coated on the surface of core block 1. Nose frame 13 is connected to the open end of heat radiating member 4 by inserting nose frame mounting portions 7, which protrudes from the end of heat radiating member 4, into recessed portions 15 formed at the lower ends of back plate 14 on nose frame 13. The core block assembled body 30 thus formed, can be mounted on carriage 20 in a vertical position with the reference lower surface of mounting portion 6 of heat radiating member 4 engaged with mounting reference surface 21 of carriage 20 and with nose frame 13 engaged with reference lower surface 7*a* of nose frame mounting portion 7.

Furthermore, heat radiating member 4 is fastened on mounting reference surface 21 of carriage 20 with screws 24 by engaging positioning joggle 17 at the lower end of nose frame 13 into positioning opening 23 of carriage 20. Hence core block assembled body 30 can be two-dimensionally positioned to nose frame 13.

Heat generated from cores 2 can be released to heat radiating member 4 via core block and heat conductive resin material 12. A portion of the heat is dissipated into the air through heat radiating member 4 while the remaining heat is transferred effectively from mounting portion 6 which is in close contact with mounting reference surface 21 of carriage 20 to guide shaft 25 by way of carriage 20, so that the printing head will not overheat.

Second Embodiment

Figure 3:
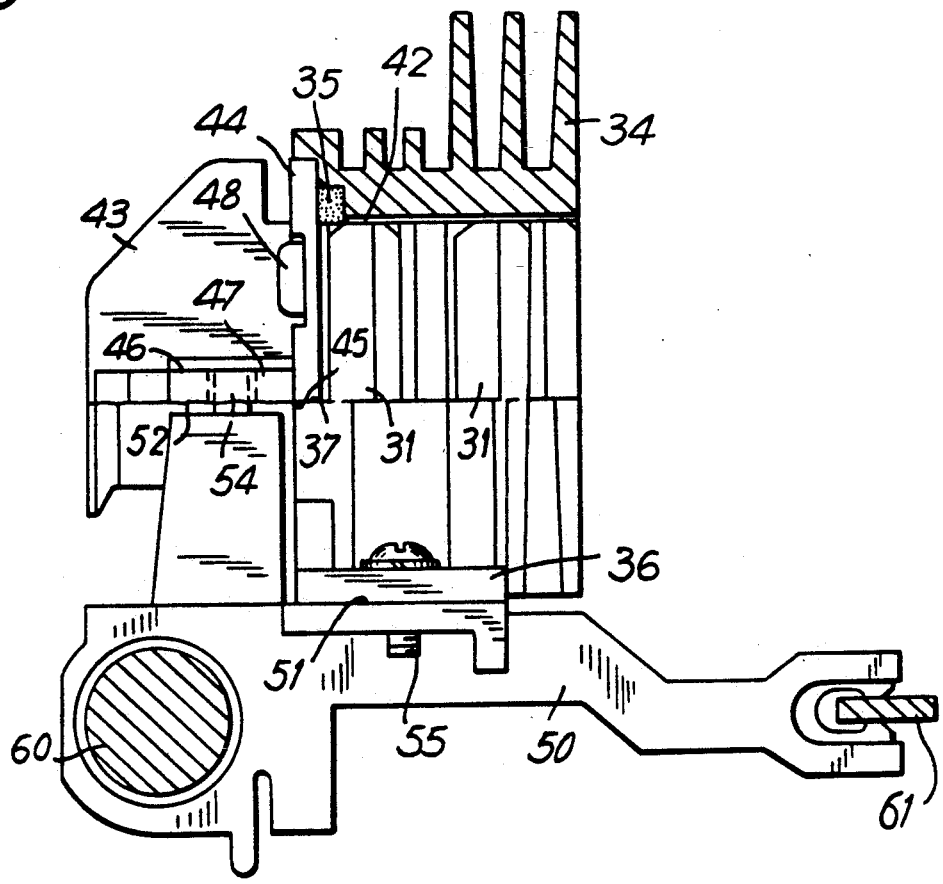
FIG. 3 is a side elevational view, partly in cross-section, showing a second embodiment of the printing head device in accordance with the present invention.
Figure 4:
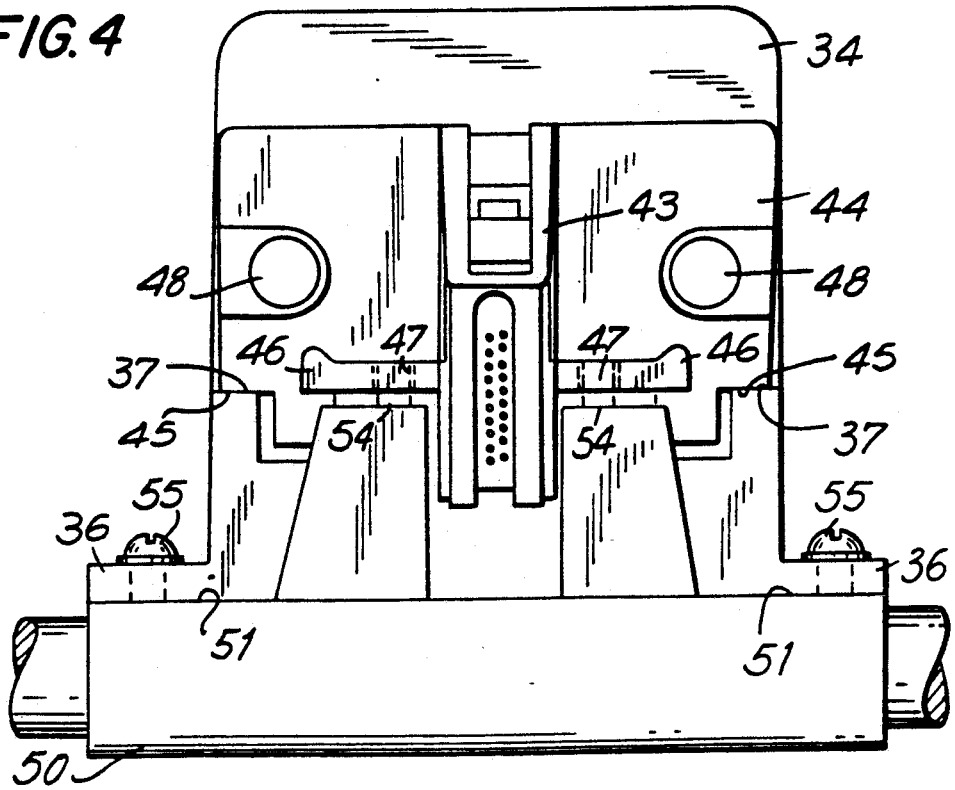
FIG. 4 is a front elevational view showing a second embodiment of a printing head device in accordance with the present invention.

The second embodiment in accordance with the present invention is illustrated in FIGS. 3 and 4. A heat radiating member 34 is installed on a mounting reference surface 51 of a carriage 50. A nose frame 43 is mounted on a nose frame mounting step portions 37 of heat radiating member 34 and is aligned by a pair of joggles 54 projecting upwardly from carriage 50. This structure offers more precise positioning and more effective heat dissipation.

Heat radiating member 34 which hermetically houses a core block 31 coated with a heat conductive resin material 42 has a laterally extending flange-like mounting portion 36 for attaching to carriage 50 on the lower end thereof. Nose frame mounting portions 46, also mounted to carriage 50, are formed so as to project laterally from the sides of nose frame 43. Nose frame mounting portions 46 have positioning openings 47 for receiving joggles 54. Step portions 45 are formed downward on both sides of a back plate 44 and formed integrally with nose frame 43 and engage nose frame mounting step portions 37.

Nose frame 43, which is mounted on nose frame mounting step portions 37, is fastened to heat radiating member 34 by screws 48. Nose frame mounting step portion 37 is precisely cut in order to maintain a precise distance between it and mounting portion 36, so that nose frame 43 is fixed accurately in the vertical direction relative to mounting portion 36. Each joggle 54 on carriage 50 is inserted into each of positioning openings 47 which are formed in mounting portions 46 of nose frame 43. Heat radiating member 34 is contacted closely with mounting reference surface 51 on carriage 50 at the lower surface of mounting portion 36 and fastened on carriage 50 with screws 55.

As in the first embodiment, accurate machining is performed to both mounting portion 36 and mounting reference surface 51. Nose frame 43 is accurately supported on carriage 50 by nose frame mounting step portion 37 in the vertical direction, and supported by joggle 54 accurately in the plane direction.

In this embodiment, the impact force which is produced during printing is vertically released along carriage 50. A moment does not occur at mounting portion 36 and therefore long term use does not loosen screws 55.

A resin reservoir 35 formed in a ring shape is also included at the open end of heat radiating member 34. When core block 31 is inserted into the open end, reservoir 35 prevents heat conductive resin material 42 from overflowing from the open end of heat radiating member 34. As a result, core block 31 can be inserted in parallel with heat radiating member 34.

Carriage 50 is mounted for displacement on guide shaft 60 and second guide member 61.

According to the present invention described above, a mounting portion is formed to couple to the lower end of the heat radiating member and to be in close contact with the mounting reference surface of the carriage. A positioning and fixing portion is formed on the nose frame and positioned using the mounting portion of the heat radiating member and the positioning portion on the carriage as a reference. The heat radiating member is fixed closely on the mounting reference surface of the carriage while the nose frame is mounted in reference to the mounting portion of the heat radiating member and the positioning portion of the carriage. These parts can be positioned and fixed accurately. The core block and nose frame can thus be positioned accurately relative to the mounting reference surface of the carriage.

Furthermore, any impact force which is exerted against the nose frame during printing can be effectively released toward the carriage, therefore protecting the printing head from any damage.

In addition, the heat produced by the core can be effectively transferred to the heat radiating member via the heat conductive resin material. The heat can also be released effectively to the carriage and the guide shaft via the mounting portion which is in close contact with the mounting reference surface of the carriage. As a result, printing can be performed without overheating the printing head.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing head for a wire impact dot printer comprising:

heat radiating means for dissipating heat from said printing head and formed with an opening;

a core block which is inserted inside said heat radiating means through said opening;

nose frame means for closing said opening;

carriage means for supporting said heat radiating means and nose frame means and formed with a mounting reference surface;

mounting means including a contact surface formed on said heat radiating means for firmly and closely securing and engaging said carriage means to said heat radiating means so that at least a portion of said contact surface and said mounting surface are in close contact for heat transfer therebetween and for fixing the position of said heat radiating means in relation to said carriage means; and positioning and fixing means formed on said nose frame means for directly joining said nose frame means to said heat radiating means and including a positioning surface for engagement against at least a portion of said contact surface of said mounting means of said heat radiating means for positioning said nose frame means relative to said heat radiating means and said mounting reference surface of said carriage means;

wherein the heat generated by said printing head is substantially released by said heat radiating means and the heat transferred from said mounting means of said heat radiating means to said mounting reference surface of said carriage means is substantially released by said carriage means.

2. The printing head of claim 1, wherein said heat radiating means is essentially cylindrical.

3. The printing head of claim 1, and including head conductive resin means closely fitting said core block within said heat radiating means and providing heat transfer therebetween.

4. The printing head of claim 3, wherein said resin means comprises a silicon resin.

5. The printing head of claim 3, wherein said heat radiating means further includes a resin reservoir to secure excess resin so that said core block is substantially evenly coated on its periphery to allow said core block to be parallel with said heat radiating means.

6. The printing head of claim 1, wherein said mounting means further includes a finished surface facing and in engagement with said mounting reference surface.

7. The printing head of claim 6, wherein said heat radiating means is cast and said surface of said mounting means is machined.

8. The printing head of claim 6, wherein said mounting reference surface is finished.

9. The printing head of claim 8, wherein said carriage means is cast and said mounting reference surface is machined for mating engagement with said surface of said mounting means.

10. The printing head of claim 9, wherein said heat radiating means is cast and said surface of said mounting means is machined.

11. The printing head of claim 8, wherein said positioning and fixing means includes a step portion having a laterally extending surface formed in said nose frame means, said heat radiating means being formed with a laterally extending surface facing and engaging said laterally extending surface of said notch means.

12. The printing head of claim 11, and including heat conductive resin means closely fitting said core block within said heat radiating means and providing heat transfer therebetween.

13. The printing head of claim 11, wherein said step portion surface and said surface of said heat radiating means are finished.

14. The printing head of claim 13, wherein said nose frame means and said heat radiating means are cast and said surfaces are machined.

15. The printing head of claim 14, and including printing wires formed on said core block to impact paper with printing ink wherein said surfaces of said nose frame means and said heat radiating member are laterally aligned with at least a portion of said printing wires.

16. The printing head of claim 15, wherein said positioning and fixing means includes two of said step portions, said step portions being positioned on opposing sides of said printing wires, said heat radiating means including two of said laterally extending surfaces, each of said step portions engaging each of the corresponding facing laterally extending surfaces of the facing step portion.

17. The printing head of claim 11, wherein said fixing and positioning means further includes at least one flange laterally extending from said nose frame means, said flange carrying at least one of a projecting positioning member and a positioning recess dimensioned to receive said projecting positioning member, said carriage means carrying the other of said projecting positioning member and said positioning recess.

18. The printing head of claim 17, printing wires formed on said core block to impact paper with printing ink, said positioning member is laterally aligned with at least a portion of said printing wires.

19. The printing head of claim 18, wherein said positioning and fixing means includes two of said flanges one on each side of said printing wires, and two of said projecting positioning members and corresponding positioning recesses.

20. The printing head of claim 17, and including heat conductive resin means closely fitting said core block within said heat radiating means and providing heat transfer therebetween.

21. The printing head of claim 8, and including heat conductive resin means closely fitting said core block within said heat radiating means and providing heat transfer therebetween.

22. The printing head of claim 6, wherein said mounting means is at least in part a laterally extending flange having said finished surface extending over at least a portion of said flange.

23. The printing head of claim 22, wherein said positioning and fixing means includes at least one laterally extending notch having a bottom portion and a top portion, said bottom portion of said notch being in engagement with at least a portion of said finished surface of said flange of said mounting means.

24. The printing head of claim 23, wherein said bottom portion of said notch is a finished surface for mating with the finished surface of said flange.

25. The printing head of claim 23, wherein said nose frame means has at least one projection extending from the top portion of said notch for engaging said bottom portion of said notch against said flange of said heat radiating means.

26. The printing head of claim 25, wherein said nose frame means has at least two of said notches and projections, each engaging with a portion of said flange.

27. The printing head of claim 23, and including heat conductive resin means closely fitting said core block within said heat radiating means and providing heat transfer therebetween.

28. The printing head of claim 1, wherein said heat radiating means includes a laterally extending flange, said positioning and fixing means including at least one laterally extending notch, the bottom surface of said flange being in pressing engagement with the bottom surface of said notch of said nose frame means.

29. The printing head of claim 28, and including heat conductive resin means closely fitting said core block within said heat radiating means and providing heat transfer therebetween.

30. The printing head of claim 28, wherein said positioning and fixing means further includes one of a projecting positioning member and a positioning recess dimensioned to receive said positioning member, said carriage means including the other of said projecting positioning member and said positioning recess, said positioning member and positioning recess laterally positioning said nose frame means relative to said mounting reference surface on said carriage means.

31. The printing head of claim 30, and including heat conductive resin means closely fitting said core block within said heat radiating means and providing heat transfer therebetween.

32. The printing head of claim 28, wherein said nose frame means has at least one projection extending from the top portion of said notch for engaging said bottom portion of said notch against said flange of said heat radiating means.

33. The printing head of claim 32, wherein said nose frame means has at least two of said notches and projections, each engaging with a portion of said flange.

34. The printing head of claim 28, wherein said bottom surface of said mounting means flange is a finished surface.

35. The printing head of claim 34, wherein said bottom surface of said notch is a finished surface.

36. The printing head of claim 34, wherein said heat radiating means is cast and said bottom surface of said mounting means flange is machined.

37. The printing head of claim 1, wherein said positioning and fixing means includes a step portion having a laterally extending surface formed in said nose frame means, said heat radiating means being formed with a laterally extending surface facing and engaging said laterally extending surface of said notch means.

38. The printing head of claim 37, and including heat conductive resin means closely fitting said core block within said heat radiating means and providing heat transfer therebetween.

39. The printing head of claim 37, wherein said step portion surface and said surface of said heat radiating means are finished.

40. The printing head of claim 39, wherein said nose frame means and said heat radiating means are cast and said surfaces are machined.

41. The printing head of claim 40, and including printing wires formed on said core block to impact paper with printing ink wherein said surfaces of said nose frame means and said heat radiating member are laterally aligned with at least a portion of said printing wires.

42. The printing head of claim 41, wherein said positioning and fixing means includes two of said step portions, said step portions being positioned on opposing sides of said printing wires, said heat radiating means including two of said laterally extending surfaces, each of said step portion engaging each of the corresponding facing laterally extending surfaces of the facing step portion.

43. The printing head of claim 42, and including heat conductive resin means closely fitting said core block within said heat radiating means and providing heat transfer therebetween.

44. The printing head of claim 37, wherein said fixing and positioning means further includes at least one flange laterally extending from said nose frame means, said flange carrying at least of one of a projecting positioning member and a positioning recess dimensioned to receive said projecting positioning member, said carriage means carrying the other of said projecting positioning member and said positioning recess.

45. The printing head of claim 44, printing wires formed on said core block to impact paper with printing ink, said positioning member is laterally aligned with at least a portion of said printing wires.

46. The printing head of claim 45, wherein said positioning and fixing means includes two of said flanges one on each side of said printing wires, and two of said projecting positioning members and corresponding positioning recesses.

47. The printing head for a wire impact dot printer comprising:

printing wires having operative end portions displaceable essentially in an axial direction to effect printing;

heat radiating means for dissipating heat from said printing head and formed with an opening having an entrance;

a core block which is inserted inside said heat radiating means through said entrance of said opening;

nose frame means mounted on said heat radiating means for at least in part closing said entrance of said opening and having an end portion, said end portion determining the position of an end portion of said printing wires;

carriage means for supporting said heat radiating means and nose frame means and formed with a mounting reference surface;

mounting means for joining said heat radiating means and said carriage means;

heat conductive resin means occupying a space formed by said opening and extending essentially laterally of said coaxial direction between the surface of said core block and the interior of said opening of said heat radiating means for closely fitting said core block within said heat radiating means and providing heat transfer therebetween; and a resin reservoir positioned adjacent to said entrance to said opening formed in said heat radiating means for receiving said nose frame means to secure excess resin from the surface of the core block when inserted in the heat radiating means so that said core block is evenly coated to allow said core block to be parallel with said heat radiating means.

48. The printing head of claim 47, wherein said resin means comprises a silicon resin.

49. The printing head of claim 47, and including horizontal positioning means on said nose frame means at a position thereon in registration with a longitudinally central portion of said printing wires for horizontally positioning by said nose frame means and therefore said operative ends of the printing wires relative to said carriage means.

50. A printing head for a wire impact dot printer, comprising:

printing wires having operative end portions displaceable essentially in an axial direction to effect printing;

heat radiating means for dissipating heat from said printing head and formed with an opening;

a core block which is inserted inside said heat radiating means through said opening;

nose frame means for closing said opening having an end portion, said end portion determining the position of said operative end portions of said printing wires;

carriage means for supporting said heat radiating means and nose frame means and formed with a mounting reference surface;

mounting means including a contact surface formed on said heat radiating means for firmly and closely securing and engaging said carriage means to said heat radiating means to that at least a portion of said contact surface and said mounting reference surface are in close contact for heat transfer therebetween and for fixing the position of said heat radiating means relative to said carriage means; and positioning and fixing means formed on said nose frame means for directly joining said nose frame means to said heat radiating means and including a positioning surface for engagement against at least a portion of said contact surface of said mounting means of said heat radiating means for positioning said nose frame means relative to said mounting means of said heat radiating means and said mounting reference surface of said carriage means, said nose frame means and therefore said operative end portions of said printing wires being positioned relative to the carriage means by said positioning and fixing means;

wherein the heat generated by said printing head is substantially released by said heat radiating means and the heat transferred from said mounting means of said heat radiating means to said mounting reference surface of said carriage means is substantially released by said carriage means.

51. The printing head of claim 50, wherein said nose frame means contacts an outer surface of said heat radiating means.

52. A printing head for a wire impact dot printer, comprising:

printing wires having operative end portions displaceable to effect printing;

heat radiating means for dissipating heat from said printing head and formed with an opening;

a core block which is inserted inside said heat radiating means through of said opening;

nose frame means for closing said opening and having an end portion, said end portion determining the position of said operative end portion of said printing wire;

carriage means for supporting said heat radiating means and nose frame means and formed with a mounting reference surface, said nose frame means and therefore said operative ends of said printing wires being positioned above said carriage means;

mounting means including a contact surface formed on said heat radiating means for firmly and closely securing and engaging said carriage means to couple said heat radiating means to that at least a portion of said contact surface and said mounting reference surface are in close contact for heat transfer therebetween and for fixing the position of said heat radiating means relative to said carriage means; and positioning and fixing means formed on said nose frame means for directly joining said nose frame means to said heat radiating means and including a positioning surface for engagement against at least a portion of said contact surface of said mounting means of said heat radiating means for positioning said nose frame means relative to said mounting means of said heat radiating means and said mounting reference surface of said carriage means;

wherein the heat generated by said printing head is substantially released by said heat radiating means and the heat transferred from said mounting means of said heat radiating means to said mounting reference surface of said carriage means is substantially released by said carriage means.

53. The printing head of claim 52, wherein said nose frame means contacts an outer surface of said heat radiating means.

54. The printing head of claim 52, and including horizontal positioning means on said nose frame means at a position thereon in registration with a longitudinally central portion of said printing wires for horizontally positioning by said nose frame means and therefore said operative ends of the printing wires relative to said carriage means.

* * * * *